US006200714B1

(12) United States Patent
Nakamura et al.

(10) Patent No.: US 6,200,714 B1
(45) Date of Patent: Mar. 13, 2001

(54) PHOTOCONDUCTOR FOR ELECTROPHOTOGRAPHY AND METHOD OF MANUFACTURING THE SAME

(75) Inventors: Yoichi Nakamura; Teruo Sasaki; Kenichi Hara; Hideki Kina; Akira Ootani, all of Nagano (JP)

(73) Assignee: Fuji Electric Imaging Device Co., Ltd. (JP)

( * ) Notice: Subject to any disclaimer, the term of this patent is extended or adjusted under 35 U.S.C. 154(b) by 0 days.

(21) Appl. No.: 09/451,883

(22) Filed: Dec. 1, 1999

(30) Foreign Application Priority Data

Dec. 15, 1998 (JP) ..... 10-355538

(51) Int. Cl.[7] ..... G03G 5/047

(52) U.S. Cl. ..... 430/58.05; 430/56; 430/970; 430/133

(58) Field of Search ..... 430/970, 56, 58.05, 430/133

(56) References Cited

U.S. PATENT DOCUMENTS 5,945,243 * 8/1999 Nakamura et al. ..... 430/970

FOREIGN PATENT DOCUMENTS 5-53348 * 3/1993 (JP) .

OTHER PUBLICATIONS

Chemical Abstracts 120:19204, 1994.*

Borsenberger, Paul M. et al. Organic Photoreceptors for Imaging Systems. New York: Marcel–Dekker, Inc. pp. 289–293, 1993.*

Grant, Roger et al. Chemical Dictionary. New York: McGraw–Hill, Inc. p. 444, 1987.*

* cited by examiner

*Primary Examiner*—Christopher D. RoDee
(74) *Attorney, Agent, or Firm*—Morrison Law Firm

(57) ABSTRACT

An electrophotographic photoconductor includes a phosphinate additive in a photosensitive film that improves the stability of the coating liquid for the photosensitive film. The electrophotographic photoconductor includes an electrically conductive substrate and a photosensitive film on the substrate. The photosensitive film contains a charge generation agent and a phosphinate compound. The photoconductor may be of either a monolayer or a laminate construction. In the case of a laminate type photoconductor, the phosphinate compound is incorporated into the charge transport layer. A method of making an electrophotographic photoconductor adds a phosphinate additive to the coating liquid for a photosensitive film to improve stability of the coating liquid. The method involves producing a coating liquid containing a phosphinate compound and coating a conductive substrate with the coating liquid to form a photosensitive film.

13 Claims, 1 Drawing Sheet

PHOTOCONDUCTOR FOR ELECTROPHOTOGRAPHY AND METHOD OF MANUFACTURING THE SAME

BACKGROUND OF THE INVENTION

The present invention relates to a photoconductor for electrophotography (hereinafter referred to as an "electrophotographic photoconductor" or simply as a "photoconductor"). Specifically, the present invention relates to an electrophotographic photoconductor that includes a photosensitive film containing organic materials on an electrically conductive substrate. The photoconductor is used in printers, copying machines and facsimiles which employ electrophotographic techniques.

It is necessary for photoconductors to retain surface charges in the dark, to generate electric charges in response to received light, and to transport the generated electric charges in response to the received light. Photoconductors may be classified into monolayered photoconductors, which have a layer that exhibits all the above described functions, and laminate-type photoconductors, which have a layer for charge generation and another layer for charge transport upon exposure to light and surface charge retention in the dark.

Conventional photoconductors employ the Carlson method for electrophotographic image formation. Image formation by the Carlson method includes the steps of charging the photoconductor in the dark by corona-discharge, forming electrostatic latent images of the original letters and pictures on the charged surface of the photoconductor, developing the electrostatic latent images with toner, and transferring the developed toner images to the carrier paper. The photoconductor is ready to be used again after steps of discharge, removal of residual toner and optical discharge are completed.

Inorganic photoconductive materials such as selenium, selenium alloys, zinc oxide and cadmium sulfide have been used as the photosensitive material for the above described photoconductors. The inorganic photoconductive materials are dispersed into a resin binder. Organic photoconductive materials such as poly-N-vinylcarbazole, 9,10-anthracenediolpolyester, hydrazone, stilbene, butadiene, benzidine, phthalocyanine and bisazo compounds have also been used as the photosensitive material for the above described photoconductors. The organic photoconductive materials are dispersed into a resin binder or deposited by vacuum deposition or by sublimation.

If necessary, various ingredients are added to the photosensitive film to improve the electrophotographic properties of the photoconductor. For example, German Patent No. 3 625 766 discloses phosphite compounds as phosphorous-containing additives. Althoughvarious additives have been examined to improve the stability of the photoconductor, a satisfactory effect has not been obtained to date.

OBJECTS AND SUMMARY OF THE INVENTION

In view of the foregoing, it is an object of the invention to provide an electrophotographic photoconductor that improves its electrophotographic properties by employing a new additive. It is another object of the invention to provide a method of manufacturing an electrophotographic photoconductor that improves the stability of the coating liquid for the photosensitive film of the photoconductor.

As used herein, the term "alkyl" is defined to include substituted or unsubstituted straight or branched carbon chains.

The inventors of the present invention have examined various additives to achieve the foregoing objects and found that a phosphinate compound contained in the photosensitive film greatly improves the electrophotographic properties of the photoconductor.

The inventors of the present invention have also found that a phosphinate compound contained in the coating liquid for the photosensitive film greatly improves the stability of the coating liquid.

Briefly stated, the present invention provides a photoconductor for electrophotography including an electrically conductive substrate and a photosensitive film on the electrically conductive substrate. The photosensitive film contains a charge transport agent and a phosphinate compound. The photoconductor may be of either a monolayer or a laminate construction.

According to another embodiment of the present invention, a method for making a photoconductor for electrophotography comprises the steps of producing a coating layer for a photosensitive film containing a phosphinate compound and then coating the photosensitive film onto a conductive substrate.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 1(*b*) is a cross section of a single layer type electrophotographic photoconductor.

DETAILED DESCRIPTION OF THE PREFERRED EMBODIMENTS

Photoconductors may be classified into three types: negative charging laminate type, positive charging laminate type, and positive charging single layer type. Hereinafter, the photoconductor of the present invention will be described in more detail in terms of a negative-charging laminate-type of FIG. 1(*a*). It is to be understood that the photoconductor of the present invention is not limited to this type of photoconductor, but would also be suitable for use in a positive-charging laminate-type photoconductor or a positive-charging monolayer type photoconductor. The materials (other than the phosphinate compounds) and processes for making the photoconductor of the invention may be selected as required, using materials and procedures well-known to those in the art.

Figure 1A:
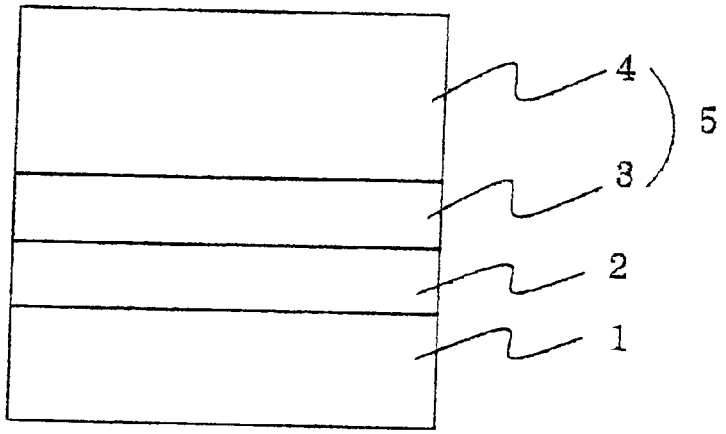
FIG. 1(*a*) is a cross section of a negative charging laminate type (function separation type) electrophotographic photoconductor.
Figure 1B:
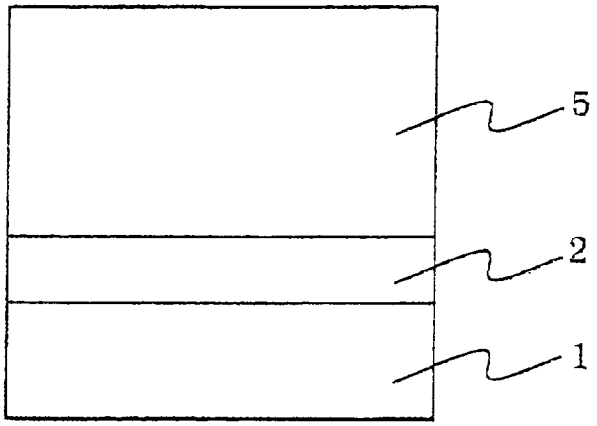

FIG. 1(*a*) is a cross section of a negative charging laminate type electrophotographic photoconductor (function-separation-type). FIG. 1(*b*) is a cross section of a single layer type electrophotographic photoconductor. Referring now to FIG. 1(*a*), the negative charging laminate type photoconductor includes an electrically conductive substrate 1, an undercoating film 2 on the substrate 1 and a photosensitive film 5 on the undercoating film 2. The undercoating film 2 is optional. The photosensitive film 5 includes a charge generation layer 3 that contributes to charge generation and a charge transport layer 4 that contributes to charge transport.

Referring now to FIG. 1(*b*), the positive charging single layer type photoconductor includes an electrically conductive substrate 1, an undercoating film 2 on the substrate 1 and a photosensitive film 5 on the undercoating film 2. An undercoating film 2 is interposed if necessary. The photosensitive film 5 in the positive charging single layer type photoconductor is a single layer that exhibits both charge generation and charge transport functions. In these photoconductors, the undercoating film 2 is not always necessary. The photosensitive films 5 in these photoconductors include a charge transport agent that transports charges in response to light exposure.

The electrically conductive substrate 1 works as an electrode of the photoconductor and a support of the other layers. The substrate 1 may be shaped as a cylindrical tube, a plate or a film. The substrate 1 may be made of a metallic material such as aluminum, stainless steel, nickel or alloys of these metals. Alternatively, an insulative material such as glass and resin may be used if the surface is treated so that it is electrically conductive.

Polyamide soluble in alcohol, aromatic polyamide soluble in solvent and thermosetting urethane resin may be used as the undercoating film 2. Preferable polyamide soluble in alcohol includes copolymers of nylon 6, nylon 8, nylon 12, nylon 66, nylon 610 and nylon 612, N-alkyl-modified nylon, and N-alkoxyalkyl-modified nylon. Commercially available copolymers for undercoating film 2 include a copolymer of nylon 6, nylon 66, nylon 610 and nylon 12 (Amilan CM 8000 supplied from TORAY INDUSTRIES, INC.), a copolymer of nylon 6, nylon 66 and nylon 12 (Elbamide 9061 supplied from Du Pont Japan Co., Ltd.) and a copolymer mainly of nylon 12 (DIAMIDE T-170 supplied from Daicel Hules Ltd.). Small grains of inorganic materials such as titanium oxide ($TiO_2$), alumina, calcium carbonate and silica may be added to the undercoating film 2.

Charge generation layer 3 may be formed by coating particles of an organic photoconductive material mixed with a resin binder onto conductive substrate 1 or undercoating film 2. Alternatively, charge generation layer 3 may be made by coating conductive substrate 1 or undercoating film 2 with a coating liquid containing a resin binder mixed with a solvent into which an organic photoconductive material is dispersed.

Charge generation layer 3 generates electric charges in response to received light. It is important for charge generation layer 3 to exhibit a high charge generation efficiency. It is also important for charge generation layer 3 to facilitate injecting generated charges into charge transport layer 4. It is further desirable for the charge generation layer 3 to have a charge-injection efficiency exhibiting a minimal electric field dependence, even under a low electric field.

Pigments including phthalocyanine compounds, azo compounds, quinone compounds, indigo compounds, cyanine compounds, squalane compounds and azulenium compounds are used as the charge generation agent. It is desirable for the charge generation layer 3 to be as thin as possible while still being thick enough to generate sufficient charges. The charge generation layer 3 is usually 5 $\mu$m thick or less and preferably 1 $\mu$m thick or less.

Charge generation layer 3 mainly contains a charge generation agent, to which a charge transport agent may be added. The charge generation layer may include polymers, copolymers, halides and cyanoethyl compounds of polycarbonate, polyester, polyamide, polyurethane, epoxy, poly(vinyl butyral), phenoxy, silicone, polymethacrylate, vinyl chloride, ketal, vinyl acetate, copolymers of these polymers, halides of these polymers and copolymers, and cyanoethyl compounds of these polymers and copolymers are used alone or in an appropriate combination as the resin binder. From 10 to 500 weight parts, preferably from 50 to 100 weight parts of a charge generation agent is used with respect to 100 weight parts of the binder resin described above.

Charge transport layer 4 is a coating layer containing a resin binder into which a charge transport agent or charge transport agents selected from various hydrazone compounds, styryl compounds, amine compounds and their derivatives are dissolved. Charge transport layer 4 works as an insulator which retains electric charges of the photoconductor in the dark, and as a conductor which transports the electric charges injected from charge generation layer 3 in response to light exposure.

The binder resin for charge transport layer 4 is selected from polymers and copolymers of, for example, polycarbonate, polyester, polystyrene and polymethacrylate, by considering the requirements for mechanical stability, chemical stability, electrical stability, adhesiveness and compatibility with the charge transport agent. From 20 to 500 weight parts, preferably from 30 to 300 weight parts of a charge transport agent is used with respect to 100 weight parts of a binder resin. The charge transport layer necessary for maintaining effective surface potential is preferably from 3 to 50 $\mu$m thick and, more preferably, from 15 to 40 $\mu$m thick.

According to the invention, the coating liquid for the charge transport layer and, therefore, the charge transport layer itself, contain a phosphinate compound. Phosphinate compounds are used for medicine and disease control as disclosed in the following literature: C. De Lassauiere, et al., German Patent No. 2 632 136; K. H. Linke, et al., Z. Anorg. Allg. Chem., 433, 119 (1997); Ohisi, et al., Japanese Unexamined Laid Open Patent Application No. S56-161310; and W. Klaeui, et al., Organometallics, 7(6),1357(1988). However, phosphinate compounds have not been used as an additive for electrophotographic photoconductors. A preferred phosphinate compound of the invention is an aryl phosphinate. Among the aryl phosphinates, a preferred compound is alkylphenyl phosphinate, as described by the following structural formula (I), where R is a lower alkyl group, such as methylphenyl phosphinate and ethylphenyl phosphinate.

(I)

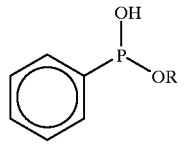

Another preferred aryl phosphinate is the 2,4-di-tert-butylphenylphenyl phosphinate described by the following structural formula (II). The phosphinate compounds are synthesized by the methods described in the foregoing literature.

(II)

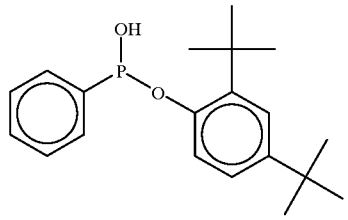

The concentration of the phosphinate compound in the photosensitive film containing the charge transport agent is preferably from 0.005 to 10 weight % and, more preferably, from 0.01 to 5 weight %.

Although not well clarified yet, the mechanism by which the phosphinate compound stabilizes the electrophotographic properties of the photoconductor and the coating liquid for the photosensitive film, may be as follows. The electron density around the phosphorous atom in the phosphinate compound is higher than the electron density around the phosphorous atom to which three oxygen atoms are bonded, as in the phosphite compound. Due to the higher electron density, the phosphinate compound exhibits stronger anti-oxidation capability than that of the phosphite compound and improves the stability of the electrophotographic properties of the photoconductor and the stability of the coating liquid.

The photosensitive film according to the invention containing charge transport agent may be either the single layer type or laminate-type. The coating liquid according to the invention that contains a charge transport agent may be coated by dip-coating, spray-coating and other conventional coating methods. The coating liquid according to the invention, to which the phosphinate compound is added, is stabilized and can be stored for a long period of time.

Although the present invention will be explained below in connection with the preferred embodiments thereof, modifications will be obvious to those skilled in the art without departing from the true spirit of the invention. Therefore, the present invention be understood not by the specific disclosures herein but by the appended claims thereof.

First Embodiment (E1)

Coating liquid is prepared by mixing 70 weight parts of a polyamide resin (Amilan CM 8000 supplied from TORAY INDUSTRIES, INC.) and 930 weight parts of methanol (supplied from Wako Pure Chemical Industries, Ltd.). The coating liquid is coated by dip-coating and dried on an aluminum substrate, resulting in an undercoating film. The resulting undercoating film is 0.5 $\mu$m thick.

Coating liquid is prepared by mixing 10 weight parts of titanyloxyphthalocyanine (synthesized in Fuji Electric Co., Ltd.), 686 weight parts of dichloromethane (supplied from Wako Pure Chemical Industries, Ltd.), 294 weight parts of 1,2-dichloroethane (supplied from Wako Pure Chemical Industries, Ltd.) and 10 weight parts of a vinyl chloride resin (MR-110 supplied from Nippon Zeon Co., Ltd.) and by dispersing the mixture using ultrasonic dispersion. The prepared coating liquid is coated by dip-coating on the undercoating film and dried, resulting in a charge generation layer. The resulting charge generation layer is 0.2 $\mu$m thick.

Coating liquid for the charge transport layer is prepared by mixing 100 weight parts of 4-(diphenylamino) benzaldehydephenyl (2-thienylmethyl) hydrazone (synthesized in Fuji Electric Co., Ltd.), 100 weight parts of a polycarbonate resin (Panlite K-1300 supplied from TEIJIN LTD.), 800 weight parts of dichloromethane, 1 weight part of a silane coupling agent (KP-340 supplied from Shin-Etsu Chemical Co., Ltd.) and 4 weight parts of 2,4-di-tert-butylphenylphenyl phosphinate (synthesized in Fuji Electric Co., Ltd.). The coating liquid thus prepared is coated by dip-coating and dried on the charge generation layer, resulting in a charge transport layer. The resulting charge transport layer is 20 $\mu$m thick. In this way, a photoconductor (E1) according to the first embodiment is made.

Second Embodiment (E2)

A photoconductor (E2) according to the second embodiment is made in the same way as photoconductor (E1) except the concentration of 2,4-di-tert-butylphenylphenyl phosphinate in the coating liquid for the charge transport layer is 0.01 weight parts.

Third Embodiment (E3)

A photoconductor (E3) according to the third embodiment is made in the same way as photoconductor (El) except the concentration of 2,4-di-tert-butylphenylphenyl phosphinate in the coating liquid for the charge transport layer is 20 weight parts.

Fourth embodiment (E4)

A photoconductor (E4) according to the fourth embodiment is made in the same way as photoconductor (E1) except 4 weight parts of methylphenyl phosphinate is contained in the coating liquid for the charge transport layer instead of 2,4-di-tert-butylphenylphenyl phosphinate.

Fifth Embodiment (E5)

A photoconductor (E5) according to the fifth embodiment is made in the same way as the photoconductor (E4) except the concentration of methylphenyl phosphinate in the coating liquid for the charge transport layer is 0.01 weight parts.

Sixth Embodiment (E6)

A photoconductor (E6) according to the sixth embodiment is made in the same way as photoconductor (E4) except the concentration of methylphenyl phosphinate in the coating liquid for the charge transport layer is 20 weight parts.

Seventh Embodiment (E7)

A photoconductor (E7) according to the seventh embodiment is made in the same way as photoconductor (E1) except 4 weight parts of ethylphenyl phosphinate is included in the coating liquid for the charge transport layer instead of 2,4-di-tert-butylphenylphenyl phosphinate.

Eighth Embodiment (E8)

A photoconductor (E8) according to the eighth embodiment is made in the same way as photoconductor (E7) except the concentration of ethylphenyl phosphinate in the coating liquid for the charge transport layer is 0.01 weight parts.

Ninth Embodiment (E9)

A photoconductor (E9) according to the ninth embodiment is made in the same way as photoconductor (E7) except the concentration of ethylphenyl phosphinate in the coating liquid for the charge transport layer is 20 weight parts.

Tenth Embodiment (E10)

A photoconductor (E10) according to the tenth embodiment is made in the same way as photoconductor (E1) except the coating liquid for the charge transport layer is stored for 1 month before it is used.

Eleventh Embodiment (E11)

A photoconductor (E11) according to the eleventh embodiment is made in the same way as the photoconductor (E2) except the coating liquid for the charge transport layer is stored for 1 month before it is used.

Twelfth Embodiment (E12)

A photoconductor (E12) according to the twelfth embodiment is made in the same way as photoconductor (E3) except the coating liquid for the charge transport layer prepared according to the third embodiment is stored for 1 month before it is used.

Thirteenth Embodiment (E13)

A photoconductor (E13) according to the thirteenth embodiment is made in the same way as photoconductor (E4) except the coating liquid for the charge transport layer is stored for 1 month before it is used.

Fourteenth Embodiment (E14)

A photoconductor (E14) according to the fourteenth embodiment is made in the same way as photoconductor (E5) except the coating liquid for the charge transport layer is stored for 1 month before it is used.

Fifteenth Embodiment (E15)

A photoconductor (E15) according to the fifteenth embodiment is made in the same way as photoconductor (E6) except the coating liquid for the charge transport layer is stored for 1 month before it is used. Sixteenth Embodiment (E16)

A photoconductor (E16) according to the sixteenth embodiment is made in the same way as photoconductor (E7) except the coating liquid for the charge transport layer is stored for 1 month before it is used.

Seventeenth Embodiment (E17)

A photoconductor (E17) according to the seventeenth embodiment is made in the same way as photoconductor (E8) except the coating liquid for the charge transport layer is stored for 1 month before it is used.

Eighteenth Embodiment (E18)

A photoconductor (E18) according to the eighteenth embodiment is made in the same way as photoconductor (E9) except that the coating liquid for the charge transport layer is stored for 1 month before it is used.

Nineteen Embodiment (E19)

A photoconductor (E19) according to the nineteenth embodiment is made in the same way as photoconductor (E1) except the concentration of 2,4-di-tert-butylphenylphenyl phosphinate in the coating liquid for the charge transport layer is 40 weight parts.

Twentieth Embodiment (E20)

A photoconductor (E20) according to the twentieth embodiment is made in the same way as photoconductor (E4) except the concentration of methylphenyl phosphinate in the coating liquid for the charge transport layer is 40 weight parts.

Twenty First Embodiment (E21)

A photoconductor (E21) according to the twenty first embodiment is made in the same way as photoconductor (E7) except the concentration of ethylphenyl phosphinate in the coating liquid for the charge transport layer is 40 weight parts.

Twenty Second Embodiment (E22)

A photoconductor (E22) according to the twenty second embodiment is made in the same way as photoconductor (E19) except that the coating liquid for the charge transport layer is stored for 1 month before it is used.

Twenty Third Embodiment (E23)

A photoconductor (E23) according to the twenty third embodiment is made in the same way as photoconductor (E20) except the coating liquid for the charge transport layer is stored for 1 month before it is used.

Twenty Fourth Embodiment (E24)

A photoconductor (E24) according to the twenty fourth embodiment is made in the same way as photoconductor (E21) except the coating liquid for the charge transport layer is stored for 1 month before it is used.

Comparative Example 1 (C1)

A photoconductor (C1) according to comparative example 1 is made in the same way as photoconductor (E1) except that 2,4-di-tert-butylphenylphenyl phosphinate is not added to the coating liquid for the charge transport layer.

Comparative Example 2 (C2)

A photoconductor (C2) according to comparative example 2 is made in the same way as photoconductor (C1) except that the coating liquid for the charge transport layer is stored for 1 month before it is used.

Evaluation

The electrophotographic properties of photoconductors made according to the first through twenty fourth embodiments and comparative examples 1 and 2 are measured using an electrostatic recording paper testing apparatus (EPA-8200 supplied from Kawaguchi Electric Manufacturing Co., Ltd.).

The residual potential of the photoconductor, the surface of which is electrified by corona discharge of −5 kV in the dark and irradiated by a 780 nm laser beam of 5 $\mu J/cm^2$, is measured as an initial residual potential. Then, the surface potential of the photoconductor, exposed to the light of 1000 lx from a white fluorescent lamp and stored for 24 hr in the dark, is measured as a residual potential after light exposure.

Table 1 lists the residual potentials of the photoconductors and the electrophotographic properties evaluated based on the measured residual potentials. The photoconductor that exhibits a residual potential after light exposure, having an absolute value of 30 V or less, is evaluated to be an excellent one.

TABLE 1

| | Initial residual potentials (V) | Residual potentials after light exposure (V) | Evaluation |
|---|---|---|---|
| E1 | −16 | −16 | Excellent |
| E2 | −16 | −16 | Excellent |
| E3 | −17 | −18 | Excellent |
| E4 | −15 | −16 | Excellent |
| E5 | −15 | −15 | Excellent |
| E6 | −16 | −17 | Excellent |
| E7 | −17 | −18 | Excellent |
| E8 | −15 | −17 | Excellent |
| E9 | −16 | −17 | Excellent |
| E10 | −17 | −16 | Excellent |
| E11 | −16 | −17 | Excellent |
| E12 | −15 | −17 | Excellent |
| E13 | −16 | −16 | Excellent |
| E14 | −15 | −17 | Excellent |
| E15 | −17 | −18 | Excellent |
| E16 | −16 | −17 | Excellent |
| E17 | −15 | −16 | Excellent |
| E18 | −17 | −18 | Excellent |
| E19 | −16 | −17 | Excellent |
| E20 | −17 | −17 | Excellent |
| E21 | −17 | −18 | Excellent |
| E22 | −17 | −17 | Excellent |
| E23 | −16 | −16 | Excellent |
| E24 | −17 | −18 | Excellent |
| C1 | −18 | −42 | Poor |
| C2 | −47 | −71 | Poor |

As Table 1 clearly indicates, the photoconductors according to the embodiments have small residual potentials and are stable. In contrast, the absolute residual potential values of the comparative photoconductors are large, indicating that the comparative photoconductors are unstable.

According to the invention, a photoconductor that exhibits excellent electrophotographic properties is obtained by doping the photosensitive film containing a charge transport agent with a phosphinate compound. Adding a phosphinate compound to the coating liquid for the photosensitive film containing a charge transport agent, stabilizes the coating liquid and facilitates making a photoconductor having excellent electrophotographic properties.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A photoconductor for electrophotography comprising:

an electrically conductive substrate;

a photosensitive film on said electrically conductive substrate;

said photosensitive film containing a charge transport agent and a compound; and said compound described by the following formula (I):

(I)

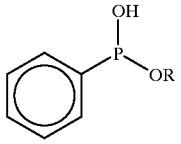

wherein R is a lower alkyl group.

2. The photoconductor for electrophotography according to claim 1, wherein:

said photosensitive film includes a charge generation layer and a charge transport layer; and said charge transport layer contains said compound.

3. The photoconductor for electrophotography according to claim 2, wherein the concentration of said compound in said photosensitive film is from 0.01 to 5 weight %.

4. The photoconductor for electrophotography according to claim 2, wherein the concentration of said compound in said photosensitive film is from 0.005 to 10 weight %.

5. The photoconductor for electrophotography according to claim 1, wherein the concentration of said compound in said photosensitive film is from 0.01 to 5 weight %.

6. The photoconductor for electrophotography according to claim 1, wherein the concentration of said compound in said photosensitive film is from 0.005 to 10 weight %.

7. A photoconductor for electrophotography comprising:

an electrically conductive substrate;

a photosensitive film on said electrically conductive substrate; and said photosensitive film containing a charge transport agent and a compound described by the following structural formula (II):

(II)

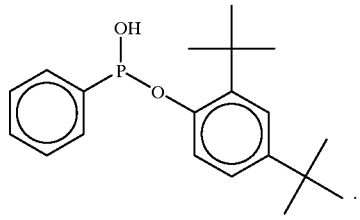

8. The photoconductor for electrophotography according to claim 7, wherein the concentration of said compound in said photosensitive film is from 0.005 to 10 weight %.

9. The photoconductor for electrophotography according to claim 7, wherein the concentration of said compound in said photosensitive film is from 0.01 to 5 weight %.

10. The photoconductor for electrophotography according to claim 7, wherein:

said photosensitive layer includes a charge generation layer and a charge transport layer; and said charge transport layer contains said compound.

11. The photoconductor for electrophotography according to claim 10, wherein the concentration of said aryl phosphinate compound in said photosensitive film is from 0.005 to 10 weight %.

12. The photoconductor for electrophotography according to claim 10, wherein the concentration of said aryl phosphinate compound in said photosensitive film is from 0.01 to 5 weight %.

13. A method of making a photoconductor for electrophotography comprising the steps of:

producing a coating layer for a photosensitive film containing a charge transport agent and a compound selected from the group consisting of formula (I) and formula (II), (I)

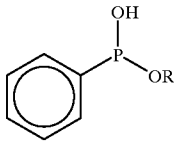

(II)

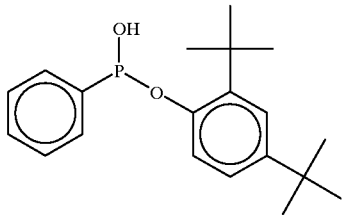

wherein R is a lower alkyl group; and coating said coating layer onto conductive substrate.

* * * * *